United States Patent [19]

Becker

[11] 4,217,710

[45] Aug. 19, 1980

[54] FRAMELESS SUPPORT FOR PICTURES

[76] Inventor: Rolf Becker, Schillstrasse 7, D-3440 Eschwege, Fed. Rep. of Germany

[21] Appl. No.: 960,372

[22] Filed: Nov. 13, 1978

[30] Foreign Application Priority Data

Nov. 24, 1977 [DE] Fed. Rep. of Germany ..... 7736004

[51] Int. Cl.[3] ..... A47G 1/06

[52] U.S. Cl. ..... 40/156; 248/488; 248/490

[58] Field of Search ..... 248/488, 440, 490; 40/155, 156, 152.1

[56] References Cited

U.S. PATENT DOCUMENTS

| | | | |
|---|---|---|---|
| 2,885,166 | 5/1959 | Lehni et al. | 248/490 |
| 3,003,272 | 10/1961 | Kulicke | 40/155 |
| 3,349,443 | 10/1967 | Sury | 248/490 |
| 3,958,352 | 5/1976 | Eubank | 40/155 |
| 3,981,091 | 9/1976 | Wiener | 40/156 |

FOREIGN PATENT DOCUMENTS

| | | | |
|---|---|---|---|
| 635806 | 4/1950 | United Kingdom | 248/490 |

*Primary Examiner*—Louis G. Mancene
*Assistant Examiner*—Wenceslao J. Contreras
*Attorney, Agent, or Firm*—Schwartz, Jeffery, Schwaab, Mack, Blumenthal & Koch

[57] ABSTRACT

Disclosed is a frameless picture support in which a picture is placed between a cover plate and a backing plate fixed together by spring clips having hooks going around the edges of the support and back parts behind the support. The back parts are kept in position behind the backing plate by headed pins with the bending of arch-like parts of the clips. The clips have steps across their widths for locking them in place against the pins.

17 Claims, 6 Drawing Figures

FRAMELESS SUPPORT FOR PICTURES

BACKGROUND OF THE INVENTION

1. Field of the Invention

The invention relates to a frameless support for pictures and other articles, comprising generally a cover plate, a backing plate and a plurality of clips. The backing plate has parts for fixing the clips on the backing plate. The clips at one end have a hook part for engaging the edge of the support and the cover plate in use, spring arms resting against the back side of the backing plate may be designed with openings for hanging up the support.

2. Description of the Prior Art

Frameless supports are described in Published German Pat. Specification (Offenlegungsschrift) No. 2,421,215, describing a clip for the frameless fixing of pictures on a backing plate. The clip comprises a hook part slipped around the picture edge and the backing plate edge and having spring arms for pushing against the back plate. The clip also has a hang-up eye in its back part. The clip is joined with the backing plate and locked in position for stopping any motion in relation to the edge of the backing plate by way of an angled part going into a groove made in the backing plate parallel to its edge. In order to make certain there is enough space for putting in the wall hook between the back part of the clip and the backing plate there is a hollow running towards the backing plate in the back part of the clip between the hang-up eye and the hook part placed around the backing plate edge. For changing the picture, it is necessary for the clip which is generally stiff to be pushed out of the hollow.

A design of the same sort is given in the German Published Specification (Offenlegungsschrift) No. 2,446,630 which is different from the first-described design more specially because of the form of the spring arm made in the back part. Additionally, the design of the space for putting the nail or the like in position is different. In the case of this design, the hook has an angled portion of its back part going into a groove parallel to the edge of the backing plate.

Such mechanical designs for joining the backing plate and the spring clips have the shortcoming that it is difficult to fix together the cover plate, the backing plate and the picture with all edges in line and at the same time support all the weight of the picture. This has to be effected by the edge near the edge of the backing plate of the groove and by the angled part of the clip.

More specifically in the case of heavy picture supports of great size, that is to say, great format, the outcome of this is that it is not only the material of the backing plate but, furthermore, the material of the clip which has to be made strong and long-lasting. The material of the clip has to have certain properties because all the weight of the picture support is taken up by the edge of the angled part of the clip. If the picture is frequently changed, wearing and damaging of the edges of the groove will necessarily take place. Furthermore, the changing of the picture takes much time and trouble, because of this purpose the clips have to be pushed into the grooves and taken out of them, this only being possible with a great amount of force, often causing damage to the hands, as for example, causing broken fingernails. Furthermore, there is the danger of loss of the clips which are taken out of position separately.

Furthermore, the grooves must run as far as the edges of the clip yielding an unpleasant aesthetic effect.

BRIEF DESCRIPTION OF THE INVENTION

One purpose of the invention is to provide a frameless support for pictures and the like, permitting the secure connection between the backing plate and the picture and, if necessary, the cover plate. Application of the invention is made even in the case of heavy structures of great size requiring the careful positioning of the different parts with their edges in line for hanging up. At the same time, even with these design requirements, frequent changing of the picture and, furthermore, a change-over between the upright and horizontal positions is to be made possible quickly and simply without a great amount of effort and without excessive wear to the clips or the engaging areas on the back of the backing plate.

For effecting these and other purposes, a frameless support for pictures or the like is provided by the invention comprising in combination:

a backing plate having a plurality of pins fixedly joined thereon in spaced relationship, each pin having a shank portion and a head portion;

a plurality of clips, each clip having a slotted resilient retaining element at one end and a hook element at the opposite end; said slotted resilient retaining element having first and second parts of generally the same length said parts being out of alignment with each other in the longitudinal direction by means of a step transverse thereto; and said hook element fixedly joined to the slotted resilient retaining element of the clip wherein the first and second parts of the slotted resilient retaining element form a continuous springing arch member with the end portions of the arch member each resting on the back side of the backing plate and wherein said slotted area extends along the longitudinal axis of the clip past the step as far as the second part of the slotted resilient retaining element with the slot width being somewhat greater than the diameter of the shanks of the pins.

Further useful design measures used in the invention are made clear in the dependent claims and in the account of the figures in the specification.

DETAILED DESCRIPTION OF THE INVENTION

Figure 1:
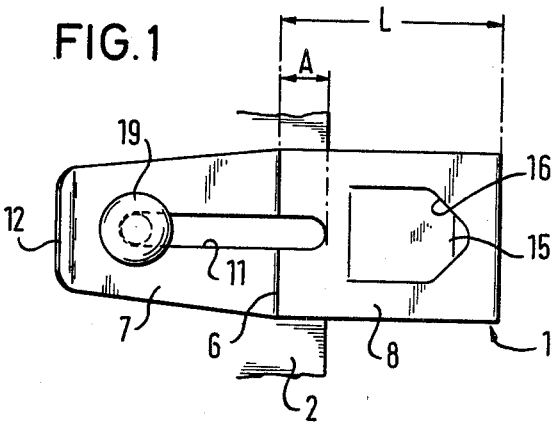
FIG. 1 is a top view of a clip of the invention joined with the pin of the backing plate in the "unclipped" condition.

The frameless support for pictures or the like of the invention comprises the combination of a backing plate 2 and a plurality of clips 1.

The clips, to be seen in FIGS. 1–6, of the frameless support of the invention are made of an elastic material as for example sheet steel, steel wire or a plastic of the necessary quality. At one end of which clip 1 there is a hook part 3, which is placed around the edge of the backing plate 2, with a picture 4 placed on it, and a cover plate 5. The part placed on the back side of the backing plate 2 of the clip 1 is arranged in the form of an elastic arch, comprising a slotted resilient retaining element which is formed by two parts 7 and 8 with a generally normal, that is to say, cross-running step 6 between them. The elastic arch with a distance H between the backing plate 2 and the edge 9 of the step 6 is placed with an arch arm 15 resting on the backing plate 2, pushed against the backing plate 2, and having a rounded end edge 14 and the end edge 12 of the clip 1, which as well is made by bending and is designed forming a pressing edge readily slipped over the backing plate 2.

In this respect, the parts 7 and 8 forming the arch do not have to be curved and, in fact, they may have different forms such as those seen in the figures. The important point is that generally the middle of the arch part under th step 6 is spaced from the backing plate 2. The space is to be so great in size that, when the step is pushed onto the backing plate, its top edge 9 is able to be pushed through under the head 19 of the pin 18.

For achieving a higher pushing or pressing force of the clip 1, the part 7 which is further from the hook part 3 may be made with a greater slope to the backing plate 2 than the part 8 forming a further part of hook part 3. In a preferred embodiment, step 6 is made sloping to some degree towards hook 3.

In part 7 of clip 1, there is a slot 11 running along the axis of clip 1 past the step 6 and continuing into part 8. The end of slot 11 in part 8 is at a distance A from step 6.

Figure 4:
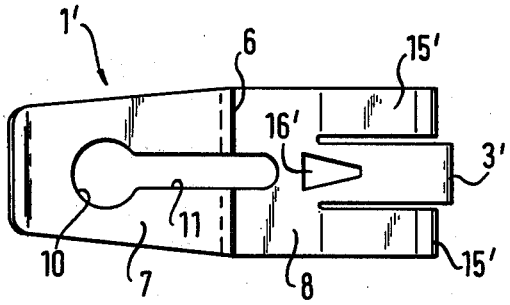
FIG. 4 is a top view of a clip of the invention adapted for easy separation from the backing plate.
Figure 5:
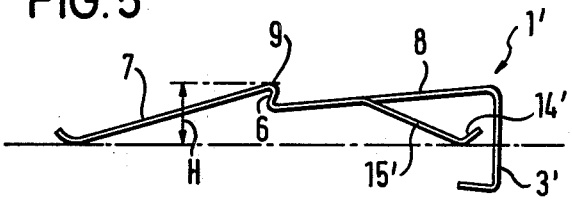
FIG. 5 is a side view of the clip of FIG. 4.
Figure 6:
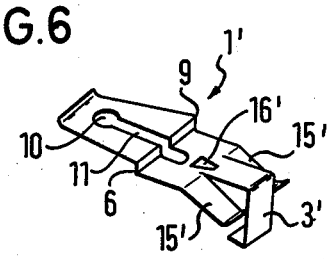
FIG. 6 is a perspective view of the clip of FIG. 4.

In another embodiment of the invention shown in FIGS. 4–6, the slot 11 has a wider end 10 in part 7.

Part 8 of clip 1 is designed forming one or more arch arms 15 and 15′ and, in addition to the hook part 3, has a hang-up opening or eye 16 or 16′ for a wall nail, hook or the like.

Figure 2:
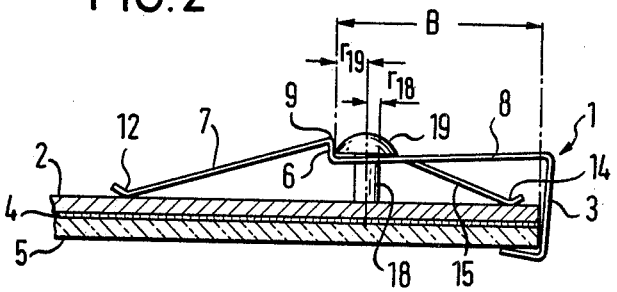
FIG. 2 is a side view of the clip of FIG. 1 in the final "clipped" position on a backing plate and pin.
Figure 3:
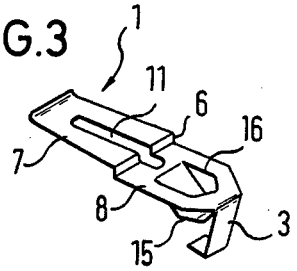
FIG. 3 is a perspective view of a clip of the invention.

In the most preferred form of the invention shown in FIGS. 1–3, the clip 1 is kept in position by the pin 18 and the head 19 so that it may not be taken off from the backing plate 2 at all, although it is able to be moved in relation to it. Furthermore, there is one arch arm 15 which is punched or stamped out of the middle of part 8 and bent out towards the hook part 3 and its free end 14 is rounded somewhat. The opening produced by the bending out of the arch arm 15 from the part 8 is in this case designed forming the hang-up opening 16 at the same time.

In order to make certain that hook part 3 continuing from the back of the support around to the front side of the support does not have an unpleasant effect, the clip 1 may be made narrower and narrower towards the hook part 3 so that hook part 3 is much narrower than the rest of the clip (See FIG. 3).

In another embodiment shown in FIGS. 4–6, the slot 11 is made wider at 10 in part 7 for slipping over the head 19 of the pin 18 (also referred to as "pin shank" or "shank" 18). This wider part may be round or may have corners. The use of a design such as that of the head 19, for example, with six sides, makes it possible to have a longer edge of step 6 resting on the head 19. Furthermore, in the embodiment of the invention shown in FIGS. 4–6, there are two arch arms 15′ placed in the part which forms a further part of the hook part 3′ of the part 8. These arms have rounded end edges 14′ of the same design as the arch arm 15 of FIGS. 1–3. In this case in part 8, there is a special hang-up opening or eye 16′. The hang-up openings 16 and 16′ may be made round, oval or advantageously with three corners, one corner pointing towards the hook part 3.

Backing plate 2 has on its back side pins 18, each having a shank portion and a head portion. These pins 18 can, for example, be riveted or screwed to the backing plate 2. They are placed at such a distance B from the edge of the backing plate 2 that the distance B between the edges facing away from the edge of the backing plate 2 of the heads 19 and the edge of the backing plate 2 is the same as the length L of the part 8. The sizes of the pins 18 are so made that their lengths are smaller than the height H of the arch formed by the clip 1 with the slipping motion of the pin 18 in the slot 11 being possible. Head 19 may furthermore be readily put into the wider part 10 of the second form of the clip which is able to be separated from the backing plate. Furthermore, the sum of the radius $r_{18}$ of the pin shank 18 with the radius $r_{19}$ of the head 19 is about the same as the distance 14 between the step 6 and the end of slot 13 in part 8 of clip 1.

In a preferred embodiment, the pins 16 are so placed on the backing plate 2 that they are on the lines halving the corner angles of the backing plate 2 and for this reason are at the same distance 20 from the two side edges of backing plate 2. Such a backing plate 2 may readily be changed over from the upright position to the horizontal position, that is to say, with the longsides upright or across by simple turning of the clips 1 about pins 18 very quickly.

In a more preferred design of the invention, the clip 1 is joined with backing plate 2 so that it may not be taken off because clip 1 is placed on pin 18 during production of backing plate 2. Such a design presents the advantage of making it impossible to lose the clips.

The assembly of an alternate picture support of the invention takes place simply by slipping the clip 1 on pin 8 so that head 19 of one pin 18 is slipped into the wider part 10 of slot 11 and the hook part 3 is pushed round the edge of backing plate 2. When this is done, the pin 18 will follow along in slot 11 and clip 1 will be pushed against the backing plate 2 and may be slipped along over the last-named running on the end edges 12 and 14. When the head 19 of pin 18 is slipped past over edge 9 of step 6, the arch part of clip 1 will be less bent and, because of this, the head 19 comes to take its position completely behind step 6. Because of the size of the distances A and B, the backing plate 2, the picture 4, and the cover plate 5 will be fixed in position with their edges in line and at the same time the spring clip 1 will be locked in the desired position.

If the picture is to be changed over, the spring clip 1 is pushed slightly towards the backing plate 2, the edge 9 of step 6 is pushed through under head 19, and because of this, hook part 3 will be cleared of the edge of cover plate 5 for changing over the picture.

Because the clips are not capable of separation from the backing plate, all of the picture support parts are fixedly and lastingly joined together so that they will not be separated even if the support should fall from the wall. The frameless support of the invention is more or less everlasting because additional materials are never needed when changing pictures. One special highlight of the invention is that the changing of pictures requires only a small pushing effect and, because the pushing force is small, the danger of damage to the hands is decreased or even non-existant.

The manner in which the edge of the head 19 is put together with the edges of the slot 11 running over the step 6, makes for a very strong connection between the clip 1 and the backing plate 2. Accidental release is not possible. For this reason, the invention is of particular advantage for heavy picture supports with a large format.

Because there are no grooves opening into the edge of the backing plate, the frameless support for pictures will be seen to be aesthetically pleasing and of particularly neat appearance.

What is claimed is:

1. A frameless support for pictures comprising in combination:

a backing plate having a plurality of pins fixedly joined thereon in spaced relationship, each pin having a shank portion and a head portion;

a plurality of clips, each clip having a slotted resilient retaining element at one end and a hook element at the opposite end; said slotted resilient retaining element having first and second parts of generally the same lengths said parts being out of alignment with each other in the longitudinal direction by means of a step transverse thereto; and said hook element fixedly joined to the slotted resilient retaining element of the clip wherein the first and second parts of the slotted resilient retaining element form a continuous springing arch member with the end portions of the arch member each resting on the back side of the backing plate and wherein said slotted area extends along the longitudinal axis of the clip past the step as far as the second part of the slotted resilient retaining element with the slot width being somewhat greater than the diameter of the shanks of the pins.

2. The frameless support of claim 1, wherein the slot is made wider in one area of the clip to a size which is somewhat greater than the diameter of the head of the pin.

3. The frameless support of claims 1 or 2, wherein the pins are so fixed on the backing plate that the space between the edge of the backing plate and the edge facing away from this edge of the head is the same as the length of the second clip part.

4. The frameless support of claim 1 wherein the slot extends into the second part of the slotted resilient retaining element to a distance to the sum of the radius ($r_{18}$) of the pin shank with the radius ($r_{19}$) of the pin head.

5. The frameless support of claim 1, wherein the height of the pin is shorter than the height of the elastic arch formed by the clip.

6. The frameless support of claim 1, wherein the arch arms are punched out of the second part of the slotted resilient retaining element.

7. The frameless support of claim 6, wherein a single arch arm is punched out of the middle of the second part of the slotted resilient retaining element.

8. The frameless support of claim 6, wherein two arch arms are punched out from the two sides of the second part of the slotted resilient retaining element and that in said second part there is hang-up opening.

9. The frameless support of claim 6, wherein the end edges of the arch arms are rounded positioning edges.

10. The frameless support of claim 1, wherein the end edge opposite the hook element of the clip is a rounded off positioning edge.

11. The frameless support of claim 1, wherein the hook element is narrower than the rest of the clip.

12. The frameless support of claim 8, wherein the hang-up opening has three corners with one corner pointing towards the hook element.

13. The frameless support of claim 1, wherein the pins are placed on lines halving the angles of the corners of the backing plate.

14. The frameless support of claim 1 wherein the clip is moveably joined with the backing plate so as not to be able to be separated from it.

15. The frameless support of claim 14, wherein the clip is made of sheet metal with spring properties.

16. The frameless support of claim 14, wherein the clip is made of wire.

17. The frameless support of claim 1 wherein said hook element comprises a first portion extending in a direction perpendicular to said first and second slotted resilient retaining element and a second portion extending perpendicular to said first portion forming a C-shaped configuration.

* * * * *